United States Patent [19]

Anderson

[11] 3,995,133

[45] Nov. 30, 1976

[54] VARIABLE POWER CONTROL FOR MICROWAVE OVEN

[75] Inventor: Carl L. Anderson, Mansfield, Ohio

[73] Assignee: The Tappan Company, Mansfield, Ohio

[22] Filed: Dec. 11, 1974

[21] Appl. No.: 531,709

[52] U.S. Cl. ..... 219/10.55 B; 200/38 R

[51] Int. Cl.[2] ..... H05B 9/06

[58] Field of Search ..... 219/10.55 B, 10.55 C, 219/10.55 R; 200/38 R, 38 A, 38 B

[56] References Cited

UNITED STATES PATENTS

| | | | |
|---|---|---|---|
| 3,824,365 | 7/1974 | Tapper | 219/10.55 B |
| 3,842,233 | 10/1974 | Lamb | 219/10.55 B |

*Primary Examiner*—Arthur T. Grimley

*Attorney, Agent, or Firm*—Donnelly, Maky, Renner & Otto

[57] ABSTRACT

An adjustable cycling switch has one condition for direct application of power to the primary winding of a transformer coupled at its secondary to energize a magnetron that provides microwaves in a microwave oven or the like. The cycling switch also has a second condition for variable adjustment to provide for periodic cyclical energization of the mentioned transformer and magnetron to reduce the effective average microwave power. During such cyclical energization of the transformer and magnetron, power is briefly supplied to the transformer through a surge protection or current limiting resistor at the beginning of each such cycle to reduce the high currents that may otherwise occur in the circuit which could damage switch contacts, the magnetron, and other circuit components; and afterwards full power is supplied and is later cut off.

20 Claims, 7 Drawing Figures

VARIABLE POWER CONTROL FOR MICROWAVE OVEN

BACKGROUND OF THE INVENTION

This invention relates to an adjustable cyclically operated switching arrangement and more particularly is directed to such a switching arrangement for variably controlling the average microwave power in a microwave oven.

A conventional technique for reducing the average power of the microwaves generated by a magnetron and delivered, for example, to the cooking cavity of a microwave oven or the like, has been to energize the magnetron through a coupling transformer in a periodic or cyclical manner. In this way within a given, say 5 minutes, operational duration, cyclical energization and de-energization of the magnetron such that the energized time equals the de-energized time will reduce the effective average power of the microwaves in the cooking cavity to an average of 50% of the power that would be delivered if the magnetron were energized continuously over that five minute duration.

The capability of reducing the average power of the microwaves in a microwave oven is an important feature when using the microwave oven to expedite the defrosting of frozen food, as is clearly described in U.S. Pat. No. 3,842,233, issued Oct. 19, 1974, which patent is assigned to the same assignee as the instant application. In the mentioned patent a current limiting resistor is connected in series circit relation with the primary winding of the coupling transformer for a short period of time at the beginning of each cyclical energization of the magnetron in order to limit current surges in the circuit, which surges might otherwise drive the transformer to saturation, reduce the effective life of the magnetron, and damage switches or other components of the circuit. After the short interval at the beginning of each energization cycle of the magnetron, the current limiting resistor is effectively short circuited or bypassed in order to provide full power to the coupling transformer and magnetron.

One drawback to the cyclical operation of the magnetron to reduce the effective power in a microwave oven for food defrosting purposes is that the cycling frequency is usually a fixed frequency and the duration within each cycle that the magnetron is energized is also fixed. Therefore, such relatively fixed defrost mode circuits are effective only for defrosting efficiently certain types of foods, but may not be so efficient for defrosting other types of foods or for providing an adjusting cooking rate for already defrosted foods.

SUMMARY OF THE INVENTION

In the instant invention the average power of the microwaves delivered, for example, to the cooking cavity of a microwave oven, may be adjusted within a range from approximately 25% to approximately 75% of the maximum power. Of course, if the magnetron and other circuit components can withstand the rapid on/off switching times and still operate effectively, the average operational power and magnetron output may be adjusted over full range of from 0% to 100%. In the preferred embodiment of the invention the power adjustment capability is provided by an adjustable cycling switching arrangement that includes a motor having a cam attached to the drive shaft, and the motor and a switch actuating lever that is operated by the cam are relatively movable for adjustment of the rotational angle of the cam at which it causes the switch operating lever to throw sequentially a pair of switches. Upon throwing of the first switch a circuit is connected to effect energization of the magnetron via a current limiting resistor, and upon throwing of the second switch, the resistor is effectively bypassed to provide full power to the magnetron. Moreover, it is noted that if the normal current surges can be tolerated without the current limiting resistor, such resistor and the first switch that puts it in the circuit may be eliminated.

It is, moreover, contemplated that the variable cycling switching arrangement, although described herein with respect to providing for wide power adjustment capability in a microwave oven, may be used in other applications requiring a variable cycling switching arrangement. The variable cycling switching arrangement also may be used to operate one or more switches either simultaneously or sequentially with the time increment between the throwing of one switch and the throwing of a second switch being readily adjustable, and the manner in which the respective switches are thrown by a spring-biased switch operating lever is believed effective to increase the expected life of the switches.

With the foregoing in mind, it is a primary object of the invention to provide for adjustability in a mechanical cycling switch.

Another object of the invention is to increase the life of cyclically operated switches by applying operating pressure to the same via a spring-biased member to apply even force in a direction substantially parallel to the normal movement direction of the switch actuator.

An additional object of the invention is to operate cyclically a plurality of switches in an adjustable sequence, and, more particularly, to control the on/off ratios of such switches.

A further object of the invention is to control adjustably the average power of a microwave oven over a relatively wide range and, more particularly, to effect such control using a switching arrangement and electrical circuit that has provision for reduction of large switching transients, such as current surges and the like.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 7 is a partial schematic electric circuit diagram of a power circuit controlled by the adjustable switching arrangement to provide power to a coupling transformer for energization of a magnetron or the like.

DESCRIPTION OF THE PREFERRED EMBODIMENT

Figure 5:
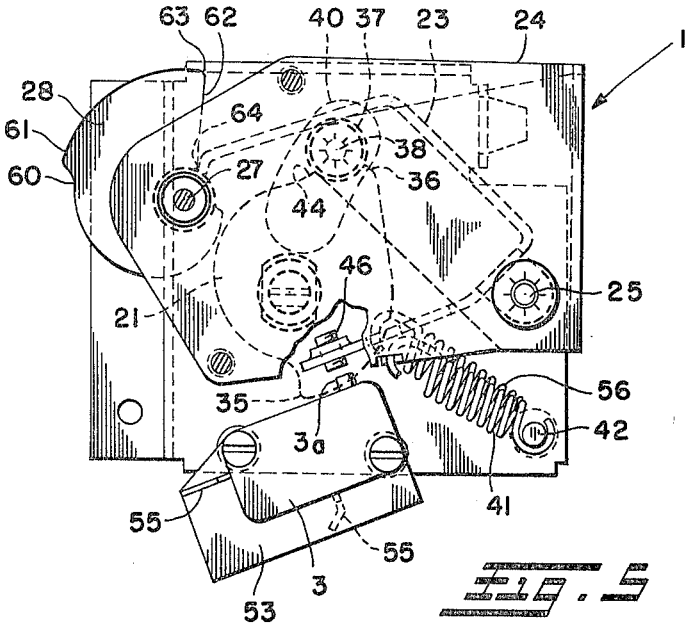
FIG. 5 is a view similar to FIG. 3 except that the power adjustment cam has been rotated counter-clockwise to a detent position for maximum power ensuring that the switch operating lever will not be able to open the switches and the motor drive switch operating cam is in its minimum position.
Figure 6:
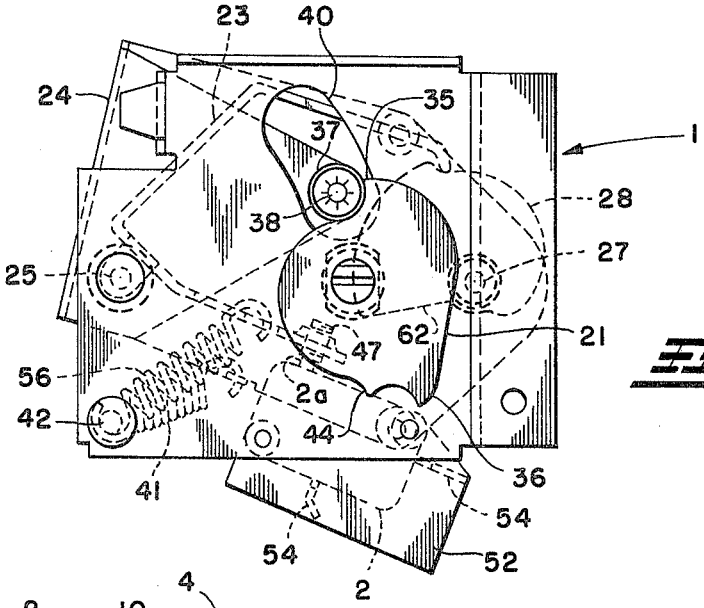
FIG. 6 is a front view of the mechanical switching arrangement looking in the direction of the arrows 6—6 of FIG. 1.
Figure 7:
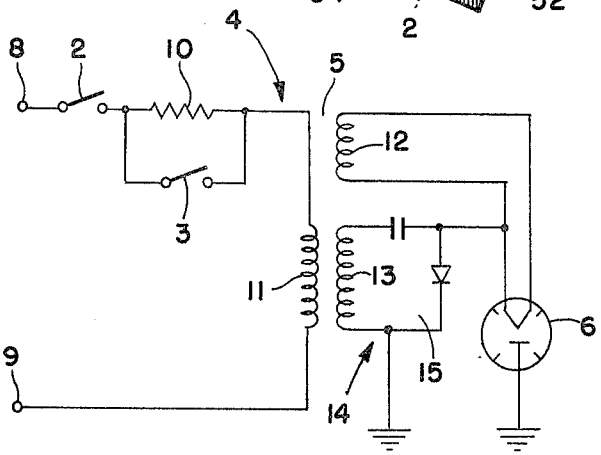

Referring now more particularly to the drawings, wherein like reference numerals desginate like parts in the several figures, the adjustable switching arrangement 1 illustrated in FIGS. 1 through 6 is intended in the preferred embodiment either to effect continuous closure of the two internally spring-biased micro switches 2, 3 in the power circuit 4 illustrated in FIG. 7 for maximum power transfer to the coupling transformer 5 to effect cyclical and sequential closing and opening the switches for reducing the average power transferred to the coupling transformer and hence reducing the effective average power of the microwaves generated by the magnetron 6 and provided, for example, to the cooking cavity of a microwave oven, the front wall of the control panel of which is shown in phantom at 7.

More specifically, concerning the electric circuit 4 of FIG. 7, assuming that various start switches, door switches, timer switches and the like are all appropriately closed, an AC signal will be provided across the terminals 8, 9. When the switch 2 is closed while the switch 3 is open, power is provided by the current limiting resistor 10 to the primary winding 11 of the coupling transformer 5 and when the switch 3 closes, current is provided directly to the transformer primary. The secondary windings 12, 13 of the transformer provide power to an output circuit 14 that provides energy directly to energize the magnetron 6. The output circuit 14 includes the first secondary winding 12 that provides heater energization in the magnetron, and the second transformer secondary 13 is coupled in a circuit 15 that provides high voltage energization for the magnetron to cause the same to generate microwaves.

With the foregoing in mind, the adjustable mechanical switching arrangement 1 illustrated in detail in FIGS. 1 through 6 will now be described with reference to operation for cyclically and sequentially operating the switches 2, 3 in the circuit 1. However, it is to be understood that the adjustable switching arrangement also may be adjusted for continuous closure of the switches for maximum power output from the magnetron 6, and the adjustable switching arrangement may be used with other devices for providing mechanical adjustment to determine the on/off ratio of one or more switches.

Turning now more particularly to FIGS. 1 through 4 and 6, the adjustable switching mechanism 1 of the invention is illustrated with the power adjustment cam 21 in the minimum average power position to effect cyclical energization of the magnetron such that in each cycle the magnetron is de-energized for a longer interval than it is energized.

The adjustable switching mechanism 1 principally includes a mounting plate 22 to which the switches 2, 3 are fixedly attached and to which a switch operating lever 23 and a generally U-shape yoke 24 are pivotally attached by a rigid mounting pin or rivet 25. An electric motor 26 supplied with electric power from the terminals 8, 9 of the power circuit 1, for example, is fixedly attached to the U-shape yoke 24, and the electric motor preferably has an internal speed reduction gear to provide a rotational output of the drive shaft 27 to which a switch operating cam 28 is supportively attached for rotation of the latter, for example, at a speed of approximately 2 rpm. Thus, the switch operating lever 23 is movable relative to the switches 2, 3 and the electric motor 26 and switch operating cam 28 are movable relative to the switch operating lever 23 in order to provide for adjustment of the rotational angle of the drive shaft 27 and switch operating cam 28 at which the latter will cause the switch operating lever 23 to operate the switches.

The power adjustment cam 21 is attached to a rotatable adjustment shaft 30, for example, by cement or the like, and the adjustment shaft 30 extends through a hole in the mounting plate 22 to the inside surface 31 thereof. An enlarged head 32 on the end of the adjustment shaft 30 is urged away from the inside surface 31 of the mounting plate by a tinnerman or similar flat spring 33 to maintain a slight tension between the abutting surfaces of the power adjustment cam 21 and the mounting plate 22 to provide a certain frictional relationship therebetween in order to require at least a minimum amount of force to effect rotation of the adjustment 30 and power adjustment cam 21.

The configuration of the power adjustment cam 21 is such that it has a relatively smooth curved surface 34 which terminates at one end in a stop 35 and at the other end in a detented end stop 36. A cam follower roller 37 is attached to the U-shape yoke 24 by a pin or rivet 38 and is movable within a slot 40 formed in the mounting plate 22. The cam follower roller 37 is normally urged to abutment with the power adjustment cam 21 by the action of a first spring 41 connected between a pin 42 attached to the mounting plate 22 and a bent notch or stud of the U-shape yoke 24, the spring 41 normally trying to draw the stud 43 toward the pin 42. Thus, as illustrated in FIGS. 3 and 4, the cam follower roller 37 is in engagement with the stop 35 of the power adjustment cam 21, and the U-shape yoke 24 is in a position rotated in its counter-clockwise-most position relative to the mounting pin 25 to provide minimum power to the magnetron of FIG. 7, as will be described in more detail below.

As the adjustment shaft 30 is rotated to effect a corresponding rotation of the power adjustment cam 21 causing the cam follower roller 37 to roll over the smooth curved surface 34, the U-shape yoke 24 will move in a clockwise direction about the mounting pin 25 to increase the average power to the magnetron 6, as will also be described in more detail below.

Figure 2:
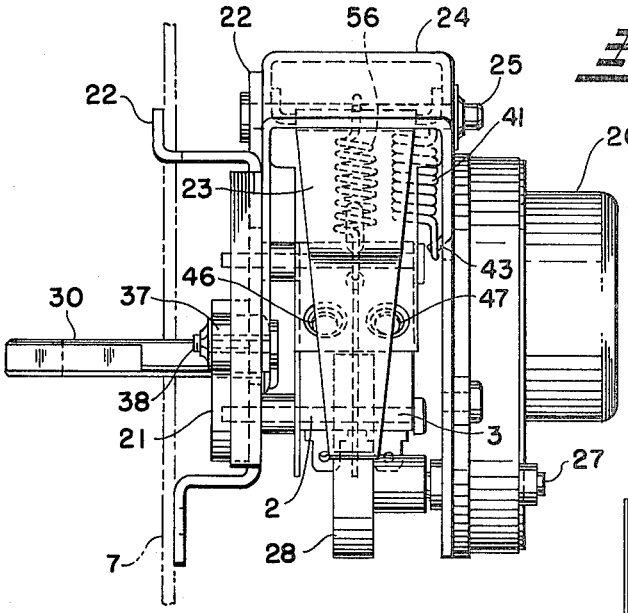
FIG. 2 is a top view of the mechanical switching arrangement of FIG. 1 looking generally in the direction of the arrows 2—2 thereof.
Figure 3:
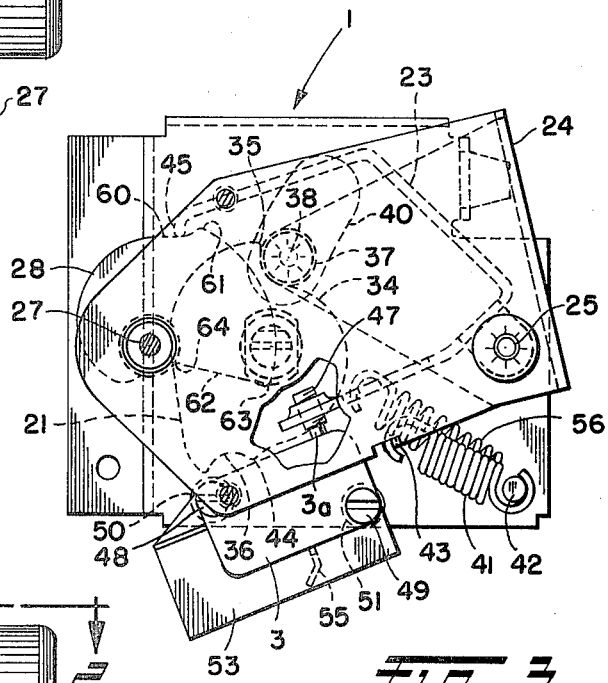
FIG. 3 is a rear side view of the mechanical switching arrangement of FIG. 1 looking generally in the direction of the arrows 3—3 thereof, with the relationship of the motor driven switch operating cam and switch actuating lever being such that the latter is in a position to urge the switches to open position and the power adjustment cam being in a minimum power position.
Figure 1:
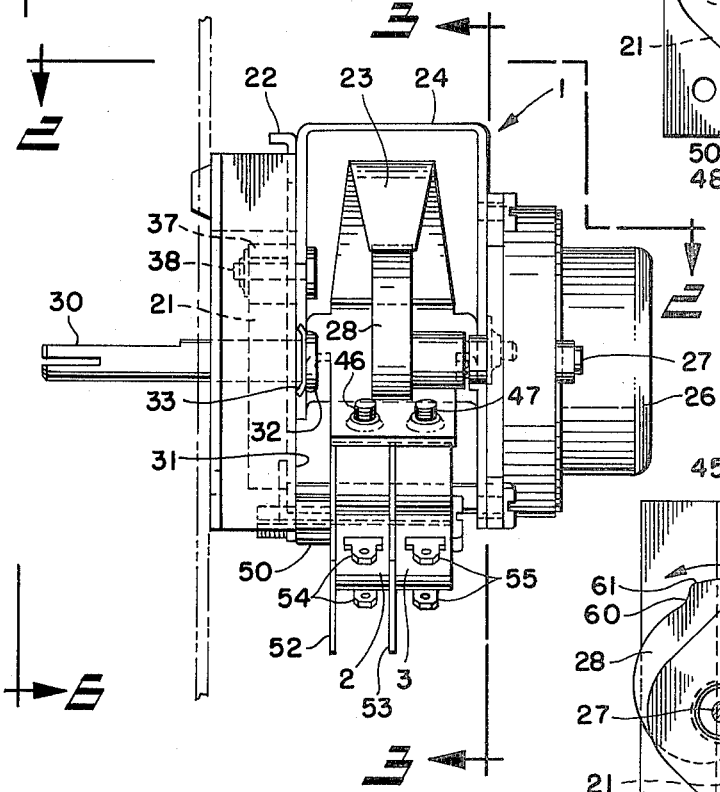
FIG. 1 is a front elevation view of the adjustable switching arrangement of the invention.
Figure 4:
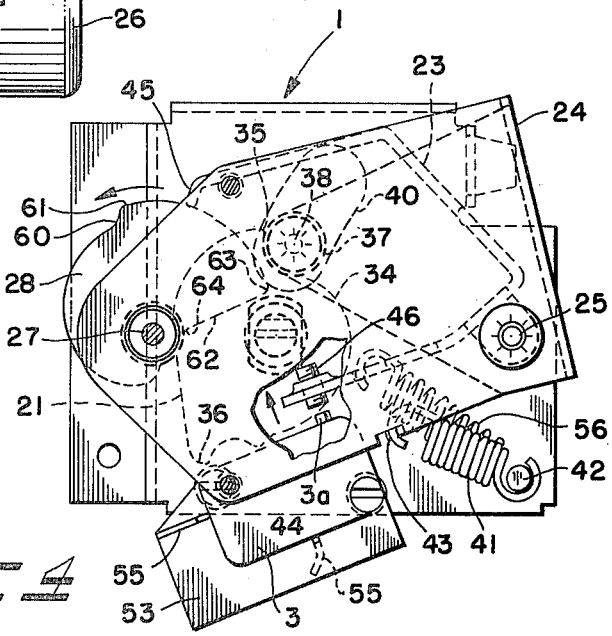
FIG. 4 is a view similar to FIG. 3 except that the motor driven switch operating cam is illustrated now in a position rotated approximately 15° counter-clockwise from the position shown in FIG. 3 having caused the switch operating lever to move away from the switches throwing them to closed position.

Moreover, in FIG. 5 it can be seen that the adjustment shaft 30 and power adjustment cam 21 have been rotated to their maximum position opposite to the position shown in FIGS. 3, 4 and 6 whereby the cam follower roller 37 has moved over a hump 44 to rest within the detented end stop 36 of the power adjustment cam. The U-shape yoke 24 is now in its maximum clockwise position relative to the mounting pin 25 with the spring 41 being fully stretched, and the switch operating lever 23 is removed from contact with the actuators of the switches 2 and 3, only the actuator 3*a* being seen in FIGS. 3, 4 and 5 and the actuator 2*a* being seen in FIG. 6, to ensure that the switches 2, 3 remain closed to provide full power to the magnetron 6 regardless of the angular position of the switch operating cam 28. It is, therefore, to be understood that the switches 2, 3 are preferably closed when the respective actuators, such as the actuator 3*a*, are released, and such switches are opened on an application of pressure to the switch actuators to throw the switches into their open condition.

Referring again to FIGS. 1, 2, 3 and 6, the switch operating lever 23 is of an off-set U-shape, and such lever includes a relatively smooth cam follower edge 45 and a pair of adjustable set screws 46, 47 positioned for applying pressure to the actuators of the respective switches 2, 3 in a direction parallel to the direction of normal movement thereof to open the same. As noted above, the switches 2, 3 are attached to the mounting plate 22, for example, by screws 48, 49 and spacers 50, 51, and are separated from the spacers and from each other by a pair of insulators 52, 53. Since the two switches 2, 3 are relatively fixedly positioned and since they are both actuatable by the same movement of the switch operating lever 23, the sequence in which the switches are respectively opened or respectively closed may be readily adjusted simply by adjustment of the respective set screws 46, 47. Moreover, as depicted in FIG. 7, each of the switches 2, 3 is a single pole single throw switch, and each has a pair of respective terminals 54, 55 for connecting the input and output terminals of the switches in the power circuit 4 of FIG. 7, although other types of switches may be used.

A second spring 56 connected between the pin 42, which is attached to the mounting plate 22, and the switch operating lever 23 urges the latter to rotate about the mounting pin 25 in a counter-clockwise direction, as illustrated, for example, in FIG. 3, in order that the set screws 46, 47 apply pressure to the actuators of the switches 2, 3 unless the cam follower edge 45 is urged by the switch operating cam 28 upwardly to move the switch operating lever clockwise about the mounting pin 25 to effect release of the switch actuators. By using the illustrated members to apply and to release pressure from the actuators of the respective switches 2, 3 through a spring-biased lever movable in a substantially parallel direction to the normal movement of the actuators, the expected life of the respective switches is increased because tangential forces on the respective switch actuators and internal parts of the switches are minimized.

In operation of the adjustable switching mechanism 1 for minimum power to the primary 11 of the transformer 5 the adjustment shaft 30 and power adjustment cam 21 are rotated such that the latter is in a position as illustrated most clearly in FIGS. 3, 4 and 6. In order to effect such minimum power operation, it is desirable that the switch 2 first be closed by a releasing action of the switch operating lever 23 and set screw 46 followed by closure of the switch 3 by release of the actuator thereof by the switch operating lever 23 and set screw 47 approximately from 7 milliseconds to 2 seconds after switch 2 has been closed. This time delay ensures that the circuit has stabilized before the current limiting resistor 10 is bypassed to supply full power to the transformer and magnetron.

As illustrated in FIGS. 3 and 6, the cam follower edge 45 of the switch operating lever 23 is in engagement with the generally spirally shaped switch operating cam 28 at a location 60 on the latter where the cam begins to slope to an exaggerated raised portion 61 that guarantees movement of the switch operating lever to release the switch actuators and close the switches 2, 3, although, as illustrated, the switches are still open. When the switch operating cam 28 is rotated several degrees further by electric motor 26 and drive shaft 27 in a counter-clockwise direction from the position shown in FIG. 3 to the position shown in FIG. 4, the cam follower edge 45 of the switch operating lever 23 is moved by the raised portion 61 of the switch operating cam to pivot about the mounting pin 25 effecting release of the two switches 2, 3 to their closed positions.

Further, it will be seen that an extension of the linear surface 62 of the switch operating cam 28 does not intersect the axis or center of rotation of the latter, but rather extends at an angle preferably in a somewhat off-center direction. Therefore, each time the cam follower edge 45 of the switch operating lever 23 reaches the junction 63 of the surface 62 and raised portion 61 of the switch operating cam 28, the cam follower edge will glide relatively slowly down the surface 62 to the point 64 on the switch operating cam. In other words, the shape, position, and function relationships of the switch operating cam 28 and, particularly, surface 62 thereof with respect to the cam follower edge 45 are preferably such that the switches 2, 3 will be operated gradually and smoothly with even torque, as opposed to by a rapid snap action, which will increase the longevity of the switches.

It can be seen from the drawing that the raised portion 61 of the switch operating cam 28 extends approximately 90° and, therefore, when the power adjustment cam 21 is in the minimum power position shown in FIG. 3, for example, the switches 2, 3 will be released and closed for only 25 percent of the time during each revolution of the switch operating cam. Moreover, the 7 millisecond to 2 second time differential between the closing of the first switch 2 and the closing of the second switch 3 easily may be adjusted by rotation of respective set screws 46, 47 in the switch operating lever. Also, it is to be understood clearly that as the power adjustment cam 21 is rotated in a counter-clockwise direction, for example, from a position as shown in FIG. 3 toward a position as shown in FIG. 5, the relative positions of the switch operating lever 23 and the U-shape yoke 24, electric motor 26 and drive shaft 27, and, ultimately, the switch operating cam 28 may be varied while the cam follower roller 37 rolls along the smooth curved surface 34 of the power adjustment cam. Such adjustment will move the switch operating cam 28 closer to the switch operating lever 23 so that the set screws 46, 47 move away from the actuators of the switches 2, 3 earlier in each rotation of the switch operating cam. When the cam follower roller 37 engages the hump 44 on the power adjustment cam 21, the switches 2, 3 will be closed approximately 75% of the time in each cycle of the switch operating cam 28.

It is noted, incidentally, that the order in which the switches 2, 3 open is not considered important to operation of the power circuit 4; rather, in the instant application of the adjustable switching arrangement the closure sequence is of prime importance. However, by adjusting the set screws 46, 47 the switching sequence and the interval between switching the respective switches may readily be determined.

When the adjustment shaft 30 and power adjustment cam 21 are rotated still further counter-clockwise such that the cam follower 37 rides over the hump 44 and falls into the detented end stop 36, the configuration of the switch operating cam 28 and its relationship with respect to the cam follower edge 45 of the switch operating lever 23 will be as illustrated in FIG. 5. Such adjustment causes the set screws 46, 47 to be continuously lifted from the actuators of the switches 2, 3 to maintain the switches closed no matter what the angular position of the switch operating cam. In this mode of operation, the transformer 5 and magnetron 6 are continuously fully energized and the power of the microwaves in the oven cooking cavity will be at the maximum level.

It should now be clear that the adjustable switching mechanism 1 of the invention provides for virtually infinite control of the average power of microwaves generated by a magnetron in a range of from approximately25% to 75% of the maximum microwave power generated by the magnetron and delivered to a microwave oven cavity, for example, over a relatively long period of time compared to the time required for a complete rotational cycle of the switch operating cam 28. Moreover, by adjusting the power adjustment cam 21 such that the cam follower roller 37 falls into the detented end stop 36, the switches 2, 3 will remain closed regardless of the angular position of the switch operating cam 28 to effect maximum average power generation by the magnetron.

It is also, of course, to be understood that although the invention is described with reference to operation of two switches, either simultaneously or sequentially, it is contemplated that the adjustable switching mechanism 20 may be used to operate only a single switch or to operate more than two switches. Also, other types of cam arrangements may be substituted for the rotating switch operating cam 28 and for the power adjustment cam 21, such as, for example, reciprocating linear cams, or the like.

The embodiments of the invention in which an exclusive property or privilege is claimed are defined as follows:

1. An adjustable cycling switching apparatus, comprising switch means for opening and closing an electric circuit, actuating means for operating said switch means, cam means for moving said actuating means to effect operation of said switch means, driving means coupled to said cam means for cyclically moving the same, said cam means being supported at a location relative to said driving means for cyclical movement thereby, and mounting means for mounting said actuating means and said cam means for relative movement, whereby said actuating means may be moved by said cam means during cyclical movement of the latter at a time determined by the relative locations of said actuating means and said cam means.

2. An adjustable cycling switching apparatus as set forth in claim 1, said switch means having a spring-biased actuator movable for opening and closing said switch means, and said actuating means being mounted for pivotal movement by said cam means to provide force to said actuator substantially in a direction parallel to the direction of normal motion of the latter.

3. An adjustable cycling switching apparatus as set forth in claim 2, said actuating means including a cam follower edge, and said cam means being rotatable by said driving means and including a generally flat surface between a first surface portion on said cam means more remote from the axis of rotation and a second surface portion on said cam means more proximate the axis of rotation, said generally flat surface being at an angle such that during rotation of said cam means said cam follower edge will move gradually along said surface from said first to said second surface portions, whereby said actuating means applies gradual force to said actuator to operate the same.

4. An adjustable cycling switching apparatus as set forth in claim 2, said switch means comprising a plurality of switches, each having a respective actuator, and said actuating means comprising a plurality of protruding members attached to a lever, each of said members being aligned with a respective actuator to apply force to the same, and at least one of said members comprising an adjustable set screw, whereby the sequence of operation of said switches by said actuating means may be varied by adjustment of said set screw.

5. An adjustable cycling switching apparatus as set forth in claim 1, said driving means comprising an electric motor having a rotatable output shaft, and said cam means being coupled for rotational movement by said shaft.

6. An adjustable cycling switching apparatus as set forth in claim 1, said mounting means comprising a mounting plate, and a rigid member extending substantially perpendicular to said mounting plate, said actuating means comprising a lever movably supported on said rigid member for pivotal movement thereabout.

7. An adjustable cycling switching apparatus as set forth in claim 6, further comprising a generally U-shape yoke, said driving means being supported on said yoke, and said yoke being movably mounted on said rigid member for pivotal movement thereabout.

8. An adjustable cycling switching apparatus as set forth in claim 7, further comprising an adjustment cam movably attached to said mounting plate, and a cam follower means attached to said yoke for following the contour of said adjustment cam, whereby movement of the latter will effect relative movement between said actuating means and said driving means.

9. An adjustable cycling switching apparatus as set forth in claim 8, further comprising resilient means for normally biasing said actuating means to apply force to said switch means and for normally biasing said yoke so that said cam follower means is in engagement with a surface of said adjustment cam.

10. An energization circuit for a microwave oven into which high frequency energy is fed from a high frequency energy generator, comprising connecting means for connecting the energization circuit to a source of electric energy, coupling means for coupling energy in the energization circuit to the high frequency energy generator for energization of the same, switch means for providing current to said coupling means for effecting energization of the high frequency energy generator, and adjustable control means having a first condition for continuous closure of said switch means and a second condition for cyclically closing and opening said switch means, said adjustable control means including cyclical means for opening and closing said switch means, said cyclical means being adjustable, whereby adjustment of the latter effects a corresponding variation in the on/off ratio of said switch means so as to vary the duration of energization of the high frequency energy generator in each cycle of said cyclical means causing a corresponding variation in the average power of the high frequency energy generated thereby over a plurality of cycles of said cyclical means.

11. An energization circuit as set forth in claim 10, said cyclical means comprising actuating means for operating said switch means, cam means for moving said actuating means to effect operation of said switch means, driving means coupled to said cam means for cyclically moving the same, said cam means being supported at a location relative to said driving means for cyclical movement thereby, and mounting means for mounting said actuating means and said cam means for relative movement, whereby said actuating means may be moved by said cam means during cyclical movement of the latter at a time determined by the relative locations of said actuating means and said cam means.

12. An energization circuit as set forth in claim 11, said actuating means including a cam follower edge, and said cam means being rotatable by said driving means and including a generally flat surface between a first surface portion on said cam means more remote from the axis of rotation and a second surface portion on said cam means more proximate the axis of rotation, said generally flat surface being at an angle such that during rotation of said cam means said cam follower edge will move gradually along said surface from said first to said second surface portions, whereby said actuating means applies gradual force to said actuator to operate the same.

13. An energization circuit as set forth in claim 11, said cam means being attached to said driving means, and further comprising means for moving said actuating means and said driving means relative to each other for adjusting the on/off ratio of said switch means.

14. An energization circuit as set forth in claim 13, said mounting means comprising a mounting plate and a rigid member extending substantially perpendicular thereto, said actuating means comprising a lever movably attached to said rigid member for pivotal movement thereabout, and said mounting means further comprising a yoke movably attached to said rigid member for pivotal movement thereabout, said driving means being directly supported by said yoke.

15. An energization circuit as set forth in claim 14, said means for moving comprising an adjustable cam movably attached to said mounting plate, a cam follower means attached to said yoke for following the contour of said adjustable cam, and resilient means for normally biasing said cam follower means into engagement with said adjustable cam, whereby adjustment of the latter will effect relative movement of said yoke.

16. An energization circuit as set forth in claim 14, said switch means comprising first and second swiches, and further comprising a resistor, said second switch being coupled in a parallel circuit with said resistor, and said first switch being connected in series with said parallel circuit, said actuating means further comprising a pair of adjustable set screws coupled in said lever and aligned respectively with said first and second switches to operate the same, whereby adjustment of said set screws effects a corresponding adjustment of the sequence of operation of said first and second switches.

17. An energization circuit as set forth in claim 11, further comprising means for effecting relative movement of said actuating means and said driving means so that said cam means effects continuous operation of said switch means.

18. An energization circuit as set forth in claim 10, said switch means comprising first and second switches, and further comprising a resistor, said second switch being connected in a parallel circuit with said resistor, and said first switch being connected in series with said parallel circuit, and said cyclical means including means for closing and opening said switches in sequence, whereby upon cyclical operation of said first and second switches, the former is first closed to provide current to said coupling means via said resistor and the latter is subsequently closed to bypass said resistor, so that at the initiation of each energization cycle of the high frequency energy generator said resistor protects the same and the energization circuit from high current surges.

19. An energization circuit for a microwave oven into which high frequency energy is fed from a high frequency energy generator, comprising connecting means for connecting the energization circuit to a source of electric energy, coupling means for coupling energy in the energization circuit to the high frequency energy generator for energization of the same, switch means for providing current to said coupling means for effecting energization of the high frequency energy generator, and adjustable control means for operating said switch means, said adjustable control means and said switch means being relatively movable selectively to effect continuous closure of said switch means or cyclical closing and opening of said switch means.

20. An energization circuit as set forth in claim 19, wherein said switch means is connected in series circuit relation with said coupling means, and said adjustable control means includes means for mechanically coupling the same to said switch means for operation thereof.

* * * * *